US005368335A

United States Patent [19]

Dinnes

[11] Patent Number: 5,368,335

[45] Date of Patent: Nov. 29, 1994

[54] CONTINGENCY TIEBACK ADAPTER

[75] Inventor: Calum J. B. Dinnes, Danestone, Scotland

[73] Assignee: ABB Vetco Gray Inc., Houston, Tex.

[21] Appl. No.: 970,664

[22] Filed: Nov. 2, 1992

[51] Int. Cl.[5] ..... F16L 37/08

[52] U.S. Cl. ..... 285/18; 166/348; 285/141; 285/308; 285/3

[58] Field of Search ..... 166/348, 382, 208; 285/141, 142, 143, 18, 308, 304, 3, 24

[56] References Cited

U.S. PATENT DOCUMENTS

| | | | |
|---|---|---|---|
| 3,288,493 | 11/1966 | Brown . | |
| 4,046,405 | 9/1977 | Bonds | 285/141 |
| 4,437,522 | 3/1984 | Krause, Jr. et al. . | |
| 4,457,368 | 7/1984 | Knierimen et al. | 285/3 |
| 4,519,633 | 5/1985 | Nichols | 285/3 |
| 4,696,493 | 9/1987 | Brammer | 285/3 |
| 4,819,454 | 4/1989 | Calder . | |
| 4,823,872 | 4/1989 | Hopmann | 285/3 |
| 4,872,708 | 10/1989 | Abreo . | |
| 4,903,992 | 2/1990 | Jennings | 285/24 |
| 4,909,546 | 3/1990 | Nobileau | 285/18 |
| 4,919,454 | 4/1990 | Caulfield et al. . | |
| 4,976,458 | 12/1990 | Hosie et al. | 166/348 |
| 5,080,173 | 1/1992 | Brammer . | |
| 5,163,514 | 11/1992 | Jennings | 166/348 |

*Primary Examiner*—Eric K. Nicholson
*Attorney, Agent, or Firm*—James E. Bradley

[57] ABSTRACT

A tieback system for a subsea well employs a tieback member that can be utilized in the event tieback threads in the casing hanger become damaged. An annular groove is formed in the bore of the wellhead housing above the casing hanger. The tieback member connects to tieback conduit and has a lower end that slides into the interior of the casing hanger. A locking device will lock the tieback member to the groove in the wellhead housing. The locking device includes a retainer which carries a radially movable locking members that are cammed outward by downward movement of the tieback member relative to the retainer.

16 Claims, 2 Drawing Sheets

CONTINGENCY TIEBACK ADAPTER

BACKGROUND OF THE INVENTION

1. Field of the Invention

This invention relates in general to subsea well equipment, and in particular to a tieback adapter for use if tieback threads in a casing hanger become damaged.

2. Description of the Prior Art

A tieback system is employed for some subsea well drilling and production operations. In a tieback system, the subsea well has a wellhead housing with multiple strings of casing supported in the wellhead housing. Each string of casing is supported by a casing hanger. An annular casing hanger seal seals between each casing hanger and the bore of the wellhead housing.

The tieback system uses a tieback member or adapter for each casing hanger. The tieback adapter is lowered on a tieback conduit, or casing, from the surface platform. The tieback member normally engages tieback threads which are formed in the interior or bowl of the casing hanger. The casing hanger has a sealing surface located in the bowl usually below the tieback threads. The tieback member engages the threads and has a lower end with seals for engaging the sealing surface.

If the tieback threads in the casing hanger become damaged, the tieback threads of the tieback member will not be able to engage the tieback threads to lock the tieback member down. It may be necessary in that event to use a much more expensive system.

SUMMARY OF THE INVENTION

The tieback member of this invention is used in the contingency that the tieback threads in the casing hanger become damaged. The tieback member carries a locking device which will engage an annular groove formed in the bore of the wellhead housing. The lower end of the tieback member will seal in the interior of the casing hanger.

The locking device includes a locking member, preferably a plurality of dogs that will move to an outer position. The dogs are carried in a retainer which lands on the casing hanger. Moving the tieback member downward after the retainer has landed on the casing hanger will cam the dogs outward into engagement with the groove.

DETAILED DESCRIPTION OF THE INVENTION

Figure 1:
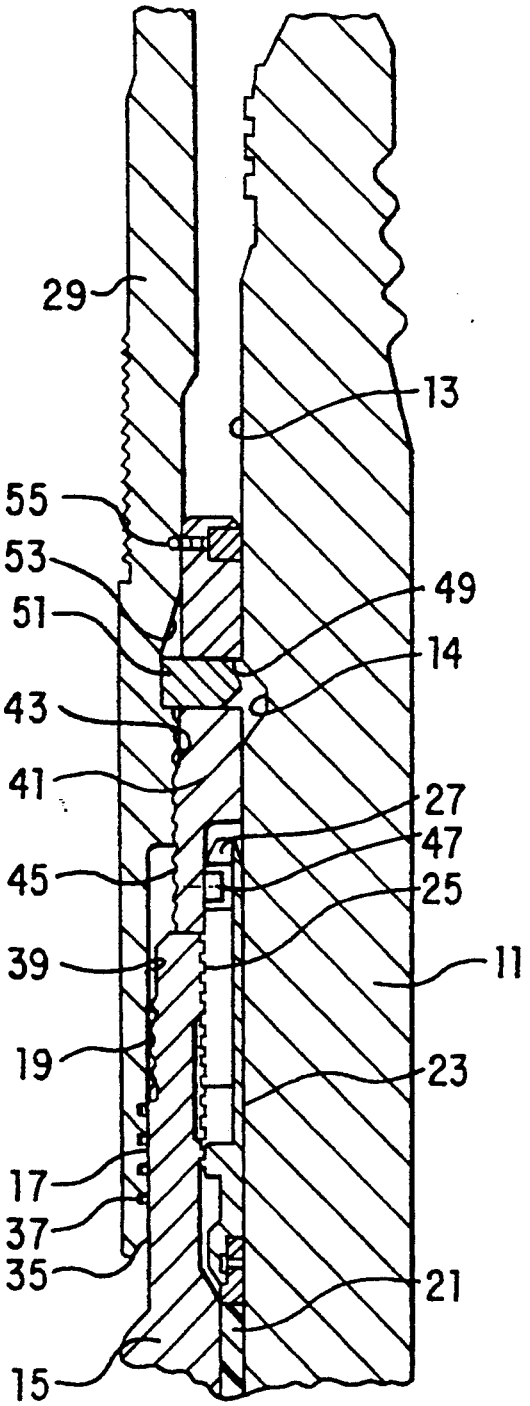
FIG. 1 is a right side cross-sectional view of portions of a subsea well, including a wellhead housing, a casing hanger, and a contingency tieback adapter constructed in accordance with this invention, and shown prior to locking the tieback adapter in place.

Referring to FIG. 1, wellhead housing 11 is a large tubular member located at the sea floor. Wellhead housing 11 has an axial bore 13. An annular groove 14 is formed in bore 13.

A number of casing hangers 15 (only one shown) are supported in wellhead housing 11. Casing hanger 15 secures to the lower end of a string of casing (not shown) that extends into the well and is cemented in place. Casing hanger 15 has a bowl or internal sealing surface 17. A set of tieback threads 19 locate above the internal sealing surface 17. Normally, a conventional tieback member or adapter (not shown) will engage tieback threads 19 to connect a tieback conduit or casing from casing hanger 15 to a platform at the surface. In this invention, tieback threads 19 will not be used because of damage that has taken place during prior operations.

Casing hanger 15 is sealed in wellhead housing 11 by a casing hanger seal 21 located on its exterior. Casing hanger seal 21 is energized and held in place by a setting ring 23. In this embodiment, casing hanger seal 21 is a conventional elastomeric member. Setting ring 23 engages threads 25 on the exterior of casing hanger 15. Setting ring 23 has a plurality of vertical circumferentially spaced slots 27 which are engaged by a running tool (not shown) to rotate setting ring 23. Rotating setting ring 23 causes it to move downward to energize and retain seal 21. Setting ring 23 protrudes above the upper end of casing hanger 15 when set. Setting ring 23 and casing hanger seal 21 may be of a variety of types.

A tieback adapter or member 29 will be lowered from the surface platform into engagement with casing hanger 15. Tieback member 29 has threads 31 (FIG. 2) on its upper end for connecting to a tieback conduit 33, which is a string of casing. Referring again to FIG. 1, tieback conduit has a lower end 35. Seals 37 locate slightly above lower end 35 for engaging the internal sealing surface 17 of casing hanger 15.

Tieback member 29 will not engage tieback threads 19. Rather, it has a cylindrical exterior surface portion 39 that is spaced radially inward from tieback threads 19 to bypass any engagement with tieback threads 19. Exterior surface portion 39 is located just above seals 37.

A contingency locking means will lock tieback member 29 to wellhead housing 11, rather than to casing hanger 15. The locking means in the preferred embodiment includes a retainer 41. Retainer 41 is a cylindrical ring having a lower end that will land on top of casing hanger 15 as the tieback member 29 is lowered into the casing hanger 15. Retainer 41 is secured to tieback member 29 by mounting means that comprises external threads 43 on tieback member 29 and internal threads 45 in retainer 41. Threads 43, 45 allow tieback member 29 to move axially relative to retainer 41 between an upper position shown in FIG. 1, and a lower position shown in FIG. 2. Threads 43, 45, will also hold the tieback member 29 in the lower position, preventing its upward movement other than by rotation in an opposite direction. Threads 43, 45 could be of a type that ratchet to allow a straight downward movement of tieback member 29 relative to retainer 41, but require rotation to move tieback member 29 back upward. An example of this type of ratchet thread mechanism is shown in U.S. Pat. No. 4,903,992, Jennings, et al., Feb. 27, 1990.

Retainer 41 has antirotation means to prevent it from rotating once it lands on casing hanger 15. The antirotation means comprises a pin 47 which extends radially outward from the lower portion of retainer 41. Pin 47 will engage one of the vertical slots 27 in the setting ring 23 of casing hanger seal 21.

Retainer 41 has a plurality of apertures 49 spaced around its circumference (only one shown). A locking member or dog 51 is carried in each aperture 49. Each dog 51 will move from a radially inward position shown in FIG. 1 to a radially outward position shown in FIG. 2. A conical cam surface 53 is formed on the exterior of tieback member 29. Moving tieback member 29 downward will result in cam surface 53 pushing dogs 51 to the outer locked position in engagement with groove 14. A shear pin 55 pins retainer 41 to tieback member 29 initially to prevent it from rotating as tieback member 29 is lowered into the wellhead housing 11.

Figure 2:
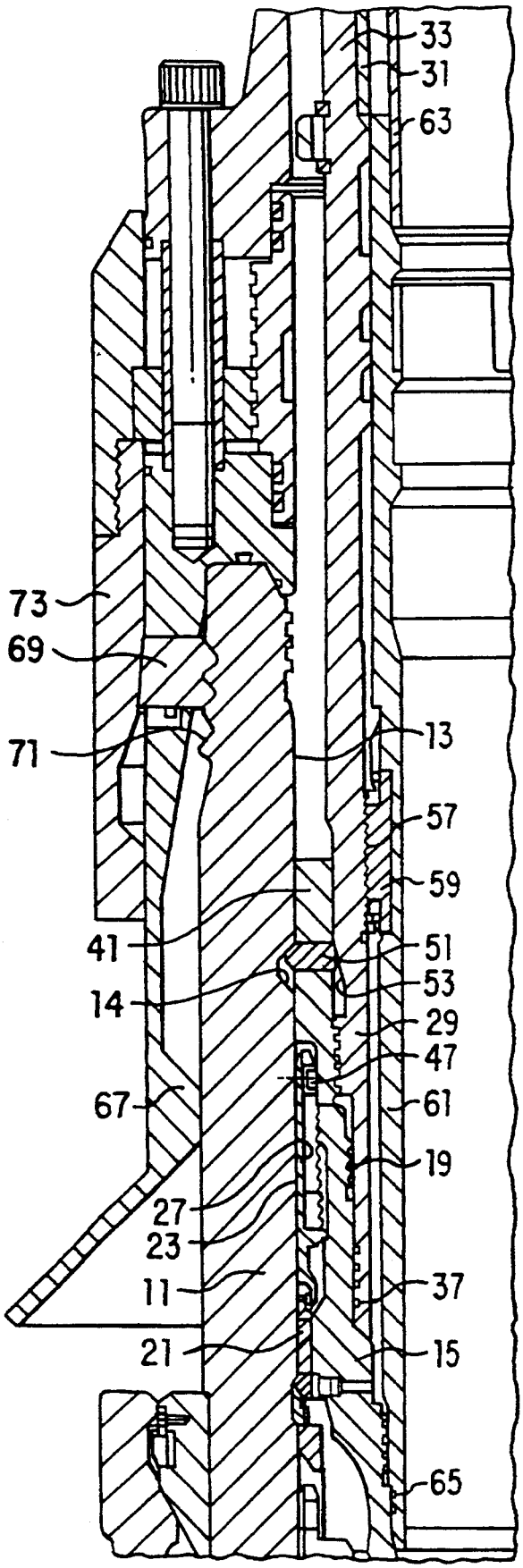
FIG. 2 is a reduced left side cross-sectional view of the subsea well of FIG. 1, showing additional structure of the subsea well, and showing the tieback adapter in a locked position.

FIG. 2 shows tieback member 29 installed, and with additional wellhead structure shown. The additional structure is conventional and includes a set of wickers 57 located in the interior of tieback member 29. Wickers 57 receive a latch 59 of an additional tieback member 61. Tieback member 61 is used to tieback a next smaller diameter well casing, and secures to a tieback conduit 63 that passes through tieback conduit 33. Tieback member 61 has a lower end with seals 65 that engage a sealing surface that is also located in casing hanger 15, but at a lower position than sealing surface 17.

A funnel assembly 67 will be employed to land a tieback riser on the wellhead housing 11 prior to lowering the tieback member 29. Funnel assembly 67 slides over the exterior of wellhead housing 11. Dogs 69 carried by funnel 67 engage grooves 71 on the exterior of wellhead housing 11. A cam sleeve 73 is moved downward to cam dogs 69 into engagement.

In operation, initially casing hanger 15 will be installed on the upper end of a string of casing (not shown) which is cemented in place. Casing hanger seal 21 will be installed in the annulus surrounding casing hanger 15. Setting ring 23 will set and retain the seal 21. Normally, at least two casing hangers will be located in wellhead housing 11, each secured to a different string of casing.

When it is desired to tieback the well to a surface platform, the operator lowers funnel assembly 67 over wellhead housing 11. Dogs 69 are used to lock funnel 67 in place. Cam sleeve 73 actuates dogs 69.

Normally, the operator would lower a tieback adapter (not shown) into engagement with tieback threads 19. If it is determined that tieback threads 19 are damaged, the operator will utilize contingency tieback member 29. The operator will secure retainer 41 to tieback member 29 at the surface. Shear pin 55 will secure retainer 41 in the position shown in FIG. 1. Tieback member 29 will be in an upper position relative to retainer 41. The operator secures the upper end of tieback member 29 to tieback conduit 33, and lowers the assembly in place.

The lower end 35 of tieback member 29 will stab into the interior of casing hanger 15. Seals 37 will slidingly engage the casing hanger internal sealing surface 17. The lower end of retainer 41 will land on top of casing hanger 15. Pin 47 will slide into one of the slots 27 in setting ring 23. The operator will then rotate tieback conduit 33. Shear pin 55 shears. This rotation rotates tieback member 29 relative to retainer 41 and to casing hanger 15. Tieback member 29 will move downward relative to retainer 41. Cam surface 53 will push dogs 51 out into engagement with groove 14. Pin 47 will prevent retainer 41 from rotating with tieback member 29. FIG. 2 shows the tieback member 29 in the lower position. Threads 43, 45 prevent the tieback member 29 from moving back upward. The operator will then install tieback member 61 in a conventional manner. Tieback member 29 can be removed by rotating it in a reverse direction.

The invention has significant advantages. The tieback member can be employed in the event that tieback threads are damaged. This avoids additional expense.

While the invention has been shown in only one of its forms, it should be apparent to those skilled in the art that it is not so limited, but is susceptible to various changes without departing from the invention.

I claim:

1. In a subsea well having a wellhead housing, a string of casing supported in a bore of the wellhead housing by a casing hanger having an internal sealing surface, an improved tieback assembly for securing a tieback conduit between the casing hanger and a platform at the surface, comprising in combination:

an annular groove formed in the bore of the wellhead housing above the casing hanger;

a tieback member having connection means for connection to the tieback conduit and a lower end;

seal means on the lower end of the tieback member for sealing the lower end of the tieback member in the internal sealing surface of the casing hanger; and locking means carried by the tieback member for locking the tieback member to the groove in the wellhead housing; and wherein the locking means comprises:

a retainer carried by the tieback member for landing on the casing hanger;

a radially expansible locking member mounted in engagement with the retainer and movable between an inner position and an outer position relative to the tieback member; and means for moving the locking member from the inner position to the outer position in response to downward movement of the tieback member relative to the casing hanger after the retainer has landed on the casing hanger.

2. In a subsea well having a wellhead housing, a string of casing supported in a bore of the wellhead housing by a casing hanger having an internal sealing surface, an improved tieback assembly for securing a tieback conduit between the casing hanger and a platform at the surface, comprising in combination:

an annular groove formed in the bore of the wellhead housing above the casing hanger;

a tieback member having connection means for connection to the tieback conduit and a lower end;

seal means on the lower end of the tieback member for sealing the lower end of the tieback member in the internal sealing surface of the casing hanger; and locking means carried by the tieback member for locking the tieback member to the groove in the wellhead housing; and wherein the locking means comprises:

a retainer mounted to the tieback member, the retainer having a lower end configured to land on an upper end of the casing hanger;

a radially expansible locking member carried by the retainer, movable between an inner position and an outer position relative to the retainer; and cam means on the tieback member for moving the locking member from the inner position to the outer position in response to downward movement of the tieback member relative to the retainer after the retainer has landed on the casing hanger.

3. In a subsea well having a wellhead housing, a string of casing supported in a bore of the wellhead housing by a casing hanger having an internal sealing surface, an improved tieback assembly for securing a tieback conduit between the casing hanger and a platform at the surface, comprising in combination:

an annular groove formed in the bore of the wellhead housing above the casing hanger;

a tieback member having connection means for connection to the tieback conduit and a lower end;

seal means on the lower end of the tieback member for sealing the lower end of the tieback member in the internal sealing surface of the casing hanger; and locking means carried by the tieback member for locking the tieback member to the groove in the wellhead housing; and wherein the locking means comprises:

a retainer mounted to the tieback member, the retainer having a lower end configured to land on an upper end of the casing hanger;

a radially expansible locking member carried by the retainer, movable between an inner position and an outer position relative to the retainer;

cam means on the tieback member for moving the locking member from the inner position to the outer position in response to downward movement of the tieback member relative to the retainer after the retainer has landed on the casing hanger; and means including a set of threads between the retainer and the tieback member for preventing the tieback member from moving back upward relative to the retainer after the locking member is in the outer position.

4. In a subsea well having a wellhead housing, a string of casing supported in a bore of the wellhead housing by a casing hanger, the casing hanger having an interior with an internal sealing surface and a set of tieback threads, an improved tieback assembly for securing a tieback conduit between the casing hanger and a platform at the surface when the tieback threads are damaged, comprising in combination:

an annular groove formed in the bore of the wellhead housing above the casing hanger;

a tieback member having an upper end having connection means for connecting to the tieback conduit and a lower end;

seal means on the lower end of the tieback member for sealing the lower end of the tieback member in the internal sealing surface of the casing hanger;

a retainer having a lower end configured to land on an upper end of the casing hanger;

mounting means for mounting the retainer to the tieback member for allowing downward movement of the tieback member relative to the retainer, but selectively preventing the tieback member from moving back upward relative to the retainer;

a radially expansible locking member carried by the retainer, movable between an inner position and an outer position relative to the retainer; and cam means on the tieback member for moving the locking member from the inner position to the outer position in response to downward movement of the tieback member relative to the retainer after the retainer has landed on the casing hanger.

5. The tieback assembly according to claim 4 wherein the cam means comprises:

a cam surface located on an exterior portion of the tieback member in engagement with an inner side of the locking member.

6. The tieback assembly according to claim 4 wherein the mounting means comprises:

a set of exterior threads on an exterior of the tieback member; and a set of interior threads on an interior of the retainer in engagement with the exterior threads.

7. The tieback assembly according to claim 4 wherein the tieback threads are located above the sealing surface, and wherein the tieback member has an exterior surface portion that is spaced radially inward out of engagement with the tieback threads when the seal means on the tieback member is in engagement with the internal sealing surface in the casing hanger.

8. The tieback assembly according to claim 4 further comprising antirotation means for preventing rotation of the retainer relative to the casing hanger after the retainer has landed on the casing hanger.

9. The tieback assembly according to claim 4 wherein the mounting means allows upward movement of the tieback member relative to the retainer by rotation of the tieback member in a selected direction.

10. In a subsea well having a wellhead housing, a string of casing supported in a bore of the wellhead housing by a casing hanger, the casing hanger having an interior with an internal sealing surface and a set of tieback threads, a casing hanger exterior seal assembly sealing between an exterior sealing surface of the casing hanger and the bore of the wellhead housing, an improved tieback assembly for securing a tieback conduit between the casing hanger and a platform at the surface when the tieback threads are damaged, comprising in combination:

an annular groove formed in the bore of the wellhead housing above the casing hanger and casing hanger seal assembly;

a tieback member with an upper end having connection means for connecting to the tieback conduit and a lower end;

seal means on the lower end of the tieback member for sealing the lower end of the tieback member in the internal sealing surface of the casing hanger;

the tieback member having an exterior surface portion above the seal means that is spaced radially inward out of engagement with the tieback threads when the seal means on the tieback member is in engagement with the internal sealing surface in the casing hanger;

a retainer mounted to the tieback member, the retainer having a lower end configured to land on an upper end of the casing hanger as the tieback member is lowered into the wellhead housing;

antirotation means mounted to the retainer for engaging the casing hanger seal assembly when the retainer lands on the casing hanger to prevent rotation of the retainer;

a radially expansible locking member carried by the retainer, movable between an inner position and an outer position relative to the retainer;

mounting means for mounting the retainer to the tieback member for allowing the tieback member to move downward relative to the retainer after the retainer has landed on the casing hanger but preventing the tieback member from moving back upward relative to the retainer unless by rotation of the tieback member relative to the retainer in a selected direction; and a cam on the tieback member in engagement with an inner side of the locking member for moving the locking member from the inner position to the outer position in response to downward movement of the tieback member relative to the retainer after the retainer has landed on the casing hanger.

11. The tieback assembly according to claim 10 wherein the mounting means comprises:

a set of exterior threads on the tieback member; and a set of interior threads in the retainer in engagement with the exterior threads.

12. The tieback assembly according to claim 10 wherein the casing hanger seal assembly has an upper end containing a slot, and wherein the antirotation means comprises:

an engaging member mounted to the retainer and protruding radially therefrom for engagement with the slot.

13. A method for securing a tieback conduit between a casing hanger and a platform at the surface, the casing hanger being secured to a string of casing and supported in a bore of a subsea wellhead housing, the casing hanger having an interior with an internal sealing surface, the method comprising:

providing an annular groove in the bore of the wellhead housing above the casing hanger;

mounting a locking assembly to a tieback member;

securing the tieback member to a lower end of a string of tieback conduit and lowering the tieback member into the wellhead housing;

sealing a lower end of the tieback member in the internal sealing surface of the casing hanger; and actuating the locking assembly to engage the groove in the wellhead housing to lock the tieback member to the wellhead housing; and wherein the step of actuating the locking assembly comprises moving the tieback member downward relative to the locking assembly.

14. A method for securing a tieback conduit between a casing hanger and a platform at the surface, the casing hanger being secured to a string of casing and supported in a bore of a subsea wellhead housing, the casing hanger having an interior with an internal sealing surface, the method comprising:

providing an annular groove in the bore of the wellhead housing above the casing hanger;

mounting a locking assembly to a tieback member;

securing the tieback member to a lower end of a string of tieback conduit and lowering the tieback member into the wellhead housing;

sealing a lower end of the tieback member in the internal sealing surface of the casing hanger; and actuating the locking assembly to engage the groove in the wellhead housing to lock the tieback member to the wellhead housing; and wherein the step of actuating the locking assembly comprises:

landing the locking assembly on the casing hanger; then moving the tieback member downward relative to the locking assembly.

15. A method for securing a tieback conduit between a casing hanger and a platform at the surface, the casing hanger being secured to a string of casing and supported in a bore of a subset wellhead housing, the casing hanger having an interior with an internal sealing surface, the method comprising:

providing an annular groove in the bore of the wellhead housing above the casing hanger;

mounting a locking assembly to a tieback member;

securing the tieback member to a lower end of a string of tieback conduit and lowering the tieback member into the wellhead housing;

sealing a lower end of the tieback member in the internal sealing surface of the casing hanger; and actuating the locking assembly to engage the groove in the wellhead housing to lock the tieback member to the wellhead housing; and wherein the step of actuating the locking assembly comprises:

landing the locking assembly on the casing hanger; then moving the tieback member downward relative to the locking assembly; and wherein the method further comprises:

preventing the tieback member from moving back upward relative to the locking assembly.

16. A method for securing a tieback conduit between a casing hanger and a platform at the surface, the casing hanger being secured to a string of casing and supported in a bore of a subsea wellhead housing, the casing hanger having an interior with an internal sealing surface, the method comprising:

providing an annular groove in the bore of the wellhead housing above the casing hanger;

mounting a locking assembly to a tieback member;

securing the tieback member to a lower end of a string of tieback conduit and lowering the tieback member into the wellhead housing;

sealing a lower end of the tieback member in the internal sealing surface of the casing hanger; and actuating the locking assembly to engage the groove in the wellhead housing to lock the tieback member to the wellhead housing; and wherein the casing hanger has a set of tieback threads located in the interior of the casing hanger above the internal sealing surface; and wherein the method further comprises:

extending the tieback member past the tieback threads into engagement with the internal sealing surface without engaging the tieback threads.

* * * * *